United States Patent [19]

Oda et al.

[11] Patent Number: 4,666,574

[45] Date of Patent: May 19, 1987

[54] ION EXCHANGE MEMBRANE CELL AND ELECTROLYTIC PROCESS USING THEREOF

[75] Inventors: Yoshio Oda; Takeshi Morimoto; Kohji Suzuki, all of Yokohama, Japan

[73] Assignee: Asahi Glass Company, Ltd., Tokyo, Japan

[21] Appl. No.: 205,567

[22] Filed: Nov. 10, 1980

[30] Foreign Application Priority Data

Nov. 27, 1979 [JP] Japan ..... 55-152416
Jul. 18, 1980 [JP] Japan ..... 55-97608

[51] Int. Cl.[4] ..... C25B 1/14

[52] U.S. Cl. ..... 204/98; 204/128; 204/263; 204/266; 204/283; 204/291; 204/292

[58] Field of Search ..... 204/98, 128, 296, 263, 204/266, 283, 291, 292

[56] References Cited

U.S. PATENT DOCUMENTS

| | | | |
|---|---|---|---|
| 4,100,050 | 7/1978 | Cook et al. | 204/98 |
| 4,135,996 | 1/1979 | Bouy et al. | 204/98 |
| 4,177,116 | 12/1979 | de Nora et al. | 204/98 |
| 4,191,618 | 3/1980 | Coher et al. | 204/98 |
| 4,268,365 | 5/1981 | Iijima et al. | 204/98 |
| 4,319,969 | 3/1982 | Oda et al. | 204/296 |
| 4,341,604 | 7/1982 | de Nora et al. | 204/283 |
| 4,343,689 | 8/1982 | de Nora et al. | 204/283 |
| 4,343,690 | 8/1982 | de Nora et al. | 204/283 |
| 4,457,822 | 7/1984 | Asano et al. | 204/252 |

FOREIGN PATENT DOCUMENTS

| | | | |
|---|---|---|---|
| 2652542 | of 0000 | Fed. Rep. of Germany | 204/98 |
| 2056493A | 3/1981 | United Kingdom | 204/283 |

*Primary Examiner*—R. L. Andrews
*Attorney, Agent, or Firm*—Oblon, Fisher, Spivak, McClelland, & Maier

[57] ABSTRACT

An ion exchange membrane cell comprises an anode, a cathode, an anode compartment and a cathode compartment formed by partitioning by an ion exchange membrane. A gas and liquid permeable porous non-electrode layer is bonded at least one of surface of said ion exchange membrane.

An ion exchange membrane comprises a gas and liquid permeable porous non-electrode layer which is bonded to at least one surface of said membrane.

An aqueous solution of an alkali metal chloride is electrolyzed in an electrolytic cell comprising an anode, a cathode, an anode compartment and a cathode compartment formed by partitioning with an ion exchange membrane wherein a gas and liquid permeable porous non-electrode layer is bonded to at least one of surfaces of said ion exchange membrane and an aqueous solution of an alkali metal chloride is fed into said anode compartment to form chlorine on said anode and to form an alkali metal hydroxide in said cathode compartment.

30 Claims, 3 Drawing Figures

ION EXCHANGE MEMBRANE CELL AND ELECTROLYTIC PROCESS USING THEREOF

BACKGROUND OF THE INVENTION

1. Field of the Invention

The present invention relates to an ion exchange membrane electrolytic cell. More particularly, it relates to an ion exchange membrane electrolytic cell suitable for an electrolysis of water or an aqueous solution of an acid, a base, an alkali metal sulfate, an alkali metal carbonate, or an alkali metal halide and to a process for electrolysis using the same.

2. Description of the Prior Art

An electroconductive material is referred to as an electric conductive material. An non-electroconductive material is referred to as an electric non-conductive material.

As a process for producing an alkali metal hydroxide by an electrolysis of an aqueous solution of an alkali metal chloride, a diaphragm method has been mainly employed instead of a mercury method in view of a prevention of a public pollution.

It has been proposed to use an ion exchange membrane in place of asbestos as a diaphragm to produce an alkali metal hydroxide by electrolyzing an aqueous solution of an alkali metal chloride so as to obtain an alkali metal hydroxide having high purity and high concentration.

On the other hand, it has been proposed to save energy in the world. From the viewpoint, it has been required to minimize a cell voltage in such technology.

It has been proposed to reduce a cell voltage by improvements in the materials, compositions and configurations of an anode and a cathode and compositions of an ion exchange membrane and a kind of ion exchange group.

It has been proposed to attain an electrolysis by a so called solid polymer electrolyte type electrolysis of an alkali metal chloride wherein a cation exchange membrane of a fluorinated polymer is bonded with gas-liquid permeable catalytic anode on one surface and a gas-liquid permeable catalytic cathode on the other surface of the membrane (British Patent No. 2,009,795, U.S. Pat. Nos. 4,210,501 and 4,214,958 and 4,217,401).

This electrolytic method is remarkably advantageous as an electrolysis at a lower cell voltage because an electric resistance caused by an electrolyte and an electric resistance caused by bubbles of hydrogen gas and chlorine gas generated in the electrolysis, can be remarkably decreased which have been considered to be difficult to reduce in the conventional electrolysis.

The anode and the cathode in this electrolytic cell are bonded on the surface of the ion exchange membrane to be embedded partially. The gas and the electrolyte solution are readily permeated so as to easily remove, from the electrode, the gas formed by the electrolysis at the electrode layer contacting with the membrane. Such porous electrode is usually made of a thin porous layer which is formed by uniformly mixing particles which act as an anode or a cathode with a binder, further graphite or the other electric conductive material. However, it has been found that when an electrolytic cell having an ion exchange membrane bonded directly to the electrode is used, the anode in the electrolytic cell is brought into contact with hydroxyl ion which is reversely diffused from the cathode compartment, and accordingly, both of chlorine resistance and an alkaline resistance for anode material are required and an expensive material must be used. When the electrode layer is bonded to the ion exchange membrane, a gas is formed by the electrode reaction between an electrode and membrane and certain deformation phenomenon of the ion exchange membrane is caused to deteriorate the characteristics of the membrane. It is difficult to work for a long time in stable. In such electrolytic cell, the current collector for electric supply to the electrode layer bonded to the ion exchange membrane should closely contact with the electrode layer. When a firm contact is not obtained, the cell voltage may be increased. The cell structure for securely contacting the current collector with the electrode layer is disadvantageously complicated.

SUMMARY OF THE INVENTION

It is an object of the present invention to provide an new electrolysis without the above-mentioned disadvantage and to reduce a cell voltage as much as possible.

The foregoing and other objects of the present invention have been attained by providing an new ion exchange membrane cell comprising an anode compartment, a cathode compartment formed by partitioning an anode and a cathode with an ion exchange membrane to which a gas and liquid permeable porous non-electrode layer is bonded and at least one of said anode and cathode is placed contacting or non-contacting with said gas and liquid permeable porous non-electrode layer.

DETAILED DESCRIPTION OF THE PREFERRED EMBODIMENTS

Figure 1:
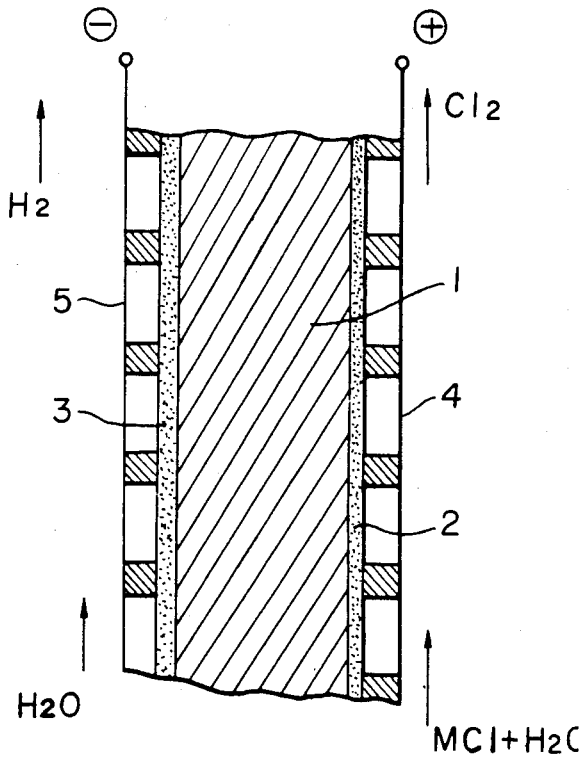
FIG. 1 is a sectional view of one embodiment of an electrolytic cell according to the present invention.

When an aqueous solution of an alkali metal chloride is electrolyzed in an electrolytic cell comprising a cation exchange membrane to which a gas and liquid permeable porous non-electrode layer is bonded according to the present invention, an alkali metal hydroxide and chlorine can be produced in remarkably lower cell voltage without the above-mentioned disadvantages.

In accordance with the present invention, at least one of the electrodes is placed through the gas and liquid permeable porous non-electrode layer whereby the electrode is not directly brought into contact with the ion exchange membrane. Therefore, high alkaline corrosion resistance is not required for the anode and the material for the anode can be selected from various materials. Moreover, the gas formed in the electrolysis is not generated in the porous layer contacting the cation exchange membrane and accordingly any trouble for the ion exchange membrane caused by the formation of a gas is not found.

In accordance with the electrolytic cell of the present invention, it is not always necessary to closely contact the electrode with the porous non-electrode layer bonded to the ion exchange membrane. Even though the electrodes are placed with a gap to the ion exchange membrane having the porous non-electrode layer, the effect for reducing the cell voltage can be obtained.

When the electrolytic cell of the present invention is used, a cell voltage can be reduced in comparison with the electrolysis of an alkali metal chloride in an electrolytic cell comprising an ion exchange membrane with which an electrodes such as expanded metal directly brought into contact without any porous non-electrode layer. This result is attained even by using an electric non-conductive material having a specific resistance such as more than $1\times10^{-1}$ Ωcm as the porous non-electrode layer, and accordingly, this is unexpected effect.

The gas and liquid permeable non-electrode layer formed on the surface of the cation exchange membrane can be made of an electric non-conductive material having a specific resistance more than $10^{-1}$ Ωcm, even more than 1.0 Ωcm which is electrochemically inactive. The porous non-electrode layer can be made of electroconductive material provided that said material has higher over-voltage than that of an electrode which is placed outside the porous layer. Thus the porous non-electrode layer means a layer which has not a catalytic action for an electrode reaction or does not act as an electrode.

The porous non-electrode layer is preferably made of a non-hydrophobic inorganic or organic material which has corrosion resistance to the electrolyte solution. The examples of such material are metals, metal oxides, metal hydroxides, metal carbides, metal nitrides and mixtures thereof and organic polymers. In the anode side, a fluorinated polymer especially a perfluoropolymer can be used.

In the case of an electrolysis of an aqueous solution of an alkali metal chloride, the porous non-electrode layer in the anode side and the cathode side is preferably made of metals in IV-A Group (preferably Ge, Sn, Pb), IV-B Group (preferably Ti, Zr, Hf), V-B Group (preferably V, Nb, Ta), VI-B Group (preferably Cr, Mo, W) and iron Group (preferably Ge, Co, Ni) of the periodic table, aluminum, manganese, antimony or alloys thereof or oxides, hydroxides, nitrides or carbides of such metal. Hydrophilic tetrafluoroethylene resins such as hydrophilic tetrafluoroethylene resin treated with potassium titanate etc. can be also preferably used.

The optimum materials for the porous non-electrode layers in the anode side or the cathode side include metals such as Fe, Ti, Ni, Zr, Nb, Ta, V and Sn or oxides, hydroxides, nitrides and carbides of such metal from the view point of corrosion resistance to the electrolyte and generated gas. A molten oxide obtained by melt-solidifying a metal oxide in a furnace such as an arc furnace, a metal hydroxide and a hydrogel of oxide is preferably used to impart a desired characteristic.

When the porous non-electrode layer is formed on the surface of the ion exchange membrane by using such material, the material in the form of powder or grain is usually used preferably with a binder of a fluorinated polymer such as polytetrafluoroethylene and polyhexafluoropropylene. As the binder, it is preferable to use a modified polytetrafluoroethylene copolymerized with a fluorinated monomer having acid group. A modified polytetrafluoroethylene is produced by polymerizing tetrafluoroethylene in an aqueous medium containing a dispersing agent with a polymerization initiator source and then, copolymerizing tetrafluoroethylene and a fluorinated monomer having an acid type functional group such as a carboxylic group or a sulfonic group in the presence of the resulting polytetrafluoroethylene to obtain a modified polytetrafluoroethylene having the modifier component of 0.001 to 10 mol%.

The material for the porous non-electrode layer is preferably in a form of particle having a diameter of 0.01 to 300μ especially 0.1 to 100μ. When the fluorinated polymer is used as the binder, the binder is preferably used in a form of a suspension at a ratio of preferably 0.01 to 100 wt.% especially 0.5 to 50 wt.% based on the powder for the porous non-electrode layer.

If desirable, it is possible to use the viscosity controling agent when the powder is applied in paste form. Suitable viscosity controling agent include water soluble materials such as cellulose derivatives such as carboxymethyl cellulose, methylcellulose and hydroxyethyl cellulose; and polyethyleneglycol, polyvinyl alcohol, polyvinyl pyrrolidone, sodium polyacrylate, polymethyl vinyl ether, casein and polyacrylamide. The agent is preferably incorporated at a ratio of 0.1 to 100 wt.% especially 0.5 to 50 wt.% based on the powder to give a desired viscosity of the powder paste. It is also possible to incorporate a desired surfactant such as long chain hydrocarbons derivatives and fluorinated hydrocarbon derivatives; and graphite or the other conductive filler so as to easily form the porous layer.

The content of the inorganic or organic particles in the porous non-electrode layer obtained is preferably in a range of 0.01 to 30 mg/cm$^2$ especially 0.1 to 15 mg/cm$^2$.

The porous non-electrode layer can be formed on the ion exchange membrane by the conventional method as disclosed in U.S. Pat. No. 4,210,501 or by a method comprising mixing the powder, if necessary, the binder, the viscosity controling agent with a desired medium such as water, an alcohol, a ketone or an ether and forming a porous cake on a filter by a filtration process and bonding the cake on the surface of the ion exchange membrane. The porous non-electrode layer can be also formed by preparing a paste having a viscosity of 0.1 to $10^5$ poise and containing the powder for the porous layer and screenprinting the paste on the surface of the ion exchange membrane as disclosed in U.S. Pat. No. 4,185,131.

The porous layer formed on the ion exchange membrane is preferably heat pressed on the membrane by a press or a roll at 80° to 220° C. under a pressure of 1 to 150 kg/cm$^2$ (or kg/cm), to bond the layer to the membrane preferably until partially embeded the layer into the surface of the membrane. The resulting porous non-electrode layer bonded to the membrane has preferably a porosity of 10 to 99% especially 25 to 95% further especially 40 to 90% and a thickness of 0.01 to 200μ especially 0.1 to 100μ further especially 1 to 50μ. The thickness of the porous non-electrode layer in the anode side can be different from that in the cathode side. Thus the porous non-electrode layer is made permeable to a gas and liquid which is an electrolyte solution, an anolyte or a catholyte solution.

The cation exchange membrane on which the porous non-electrode layer is formed, can be made of a polymer having cation exchange groups such as carboxylic acid groups, sulfonic acid groups, phosphoric acid groups and phenolic hydroxy groups. Suitable polymers include co-polymers of a vinyl monomer such as tetrafluoroethylene and chlorotriluoroethylene and a perfluorovinyl monomer having an ion-exchange group such as sulfonic acid group, carboxylic acid group and phosphoric acid group or a reactive group which can be converted into the ion-exchange group. It is also possible to use a membrane of a polymer of trifluoroethylene in which ion-exchange groups such as sulfonic acid group are introduced or a polymer of styrene-divinyl benzene in which sulfonic acid groups are introduced.

The cation exchange membrane is preferably made of a fluorinated polymer having the following units $$\text{(M)} \quad \left(CF_2-CXX'\right) \quad \text{(M mole \%)}$$

$$\text{(N)} \quad \left(CF_2-\underset{\underset{Y-A}{|}}{CX}\right) \quad \text{(N mole \%)}$$

wherein X represents fluorine, chlorine or hydrogen atom or $-CF_3$; X' represents X or $CF_3(CH_2)_m$; m represents an integer of 1 to 5.

The typical examples of Y have the structures bonding A to a fluorocarbon group such as $$\left(CF_2\right)_x,\ -O\left(CF_2\right)_x,\ \left(O-CF_2-\underset{\underset{Z}{|}}{CF}\right)_y,$$

$$-CF_2\left(O-CF_2-\underset{\underset{Z}{|}}{CF}\right)_y,\ \left(O-CF_2-\underset{\underset{Z}{|}}{CF}\right)_x\left(O-CF_2-\underset{\underset{Rf}{|}}{CF}\right)_y \text{ and}$$

$$-O-CF_2\left(\underset{\underset{Z}{|}}{CF}-O-CF_2\right)_x\left(CF_2\right)_y\left(CF_2-O-\underset{\underset{Rf}{|}}{CF}\right)_z$$

x, y and z respectively represent an integer of 1 to 10; Z and Rf represent —F or a $C_1$–$C_{10}$ perfluoroalkyl group; and A represents —COOM or $-SO_3M$, or a functional group which is convertible into —COOM or $-SO_3M$ by a hydrolysis or a neutralization such as —CN, —COF, $-COOR_1$, $-SO_2F$ and $-CONR_2R_3$ or $-SO_2NR_2R_3$ and M represents hydrogen or an alkali metal atom; $R_1$ represents a $C_1$–$C_{10}$ alkyl group; $R_2$ and $R_3$ represent H or a $C_1$–$C_{10}$ alkyl group.

It is preferable to use a fluorinated cation exchange membrane having an ion exchange group content of 0.5 to 4.0 miliequivalence/gram dry polymer especially 0.8 to 2.0 miliequivalence/gram dry polymer which is made of said copolymer.

In the cation exchange membrane of a copolymer having the units (M) and (N), the ratio of the units (N) is preferably in a range of 1 to 40 mol % preferably 3 to 25 mol %.

The cation exchange membrane used in this invention is not limited to be made of only one kind of the polymer. It is possible to use a laminated membrane made of two kinds of the polymers having lower ion exchange capacity in the cathode side, for example, having a weak acidic ion exchange group such as carboxylic acid group in the cathode side and a strong acidic ion exchange group such as sulfonic acid group in the anode side.

The cation exchange membrane used in the present invention can be fabricated by blending a polyolefin such as polyethylene, polypropylene, preferably a fluorinated polymer such as polytetrafluoroethylene and a copolymer of ethylene and tetrafluoroethylene.

The membrane can be reinforced by supporting said copolymer on a fabric such as a woven fabric or a net, a non-woven fabric or a porous film made of said polymer or wires, a net or a perforated plate made of a metal. The weight of the polymers for the blend or the support is not considered in the measurement of the ion exchange capacity.

The thickness of the membrane is preferably 20 to 500 microns especially 50 to 400 microns.

The porous non-electrode layer is formed on the surface of the ion exchange membrane preferably in the anode side and the cathode side by bonding to the ion exchange membrane which is suitable for bonding such as in a form of ion exchange group which is not decomposed, for example, an acid or ester form in the case of carboxylic acid group and $-SO_2F$ group in the case of sulfonic acid group, preferably under heating the membrane to give a molten viscosity of $10^2$ to $10^{10}$ poise especially $10^4$ to $10^8$ poise.

In the electrolytic cell of the present invention, various electrodes can be used, for example, foraminous electrodes having openings such as a porous plate, a screen or an expanded metal are preferably used. The electrode having openings is preferably an expanded metal with openings of a major length of 1.0 to 10 mm preferably 1.0 to 7 mm and a minor length of 0.5 to 10 mm preferably 0.5 to 4.0 mm, a width of a mesh of 0.1 to 2.0 mm preferably 0.1 to 1.5 mm and a ratio of opening area of 20 to 95% preferably 30 to 90%.

A plurality of plate electrodes can be used in layers. In the case of a plurality of electrodes having different opening area being used in layers, the electrode having smaller opening area is placed close to the membrane.

The electrode used in the present invention has a lower over-voltage than that of the material of the porous non-electrode layer bonded to the ion exchange membrane. Thus the anode has a lower chlorine overvoltage than that of the porous layer at anode side and the cathode has a lower hydrogen over-voltage than that of the porous layer at cathode side in the case of the electrolysis of alkali metal chloride. The material of the electrode used depends on the material of the porous non-electrode layer bonded to the membrane.

The anode is usually made of a platinum group metal or alloy, a conductive platinum group metal oxide or a conductive reduced oxide thereof.

The cathode is usually a platinum group metal or alloy, a conductive platinum group metal oxide or an iron group metal or alloy.

The platinum group metal can be Pt, Rh, Ru, Pd, Ir. The cathode is iron, cobalt, nickel, Raney nickel, stabilized Raney nickel, stainless steel, a stainless steel treated by etching with a base (U.S. Ser. No. 879751) Raney nickel plated cathode (U.S. Pat. No. 4,170,536 and No. 4,116,804) nickel rhodanate plated cathode (U.S. Pat. No. 4,190,514 and No. 4,190,516).

When the electrode having opening is used, the electrode can be made of the materials for the anode or the cathode by itself. When the platinum metal or the conductive platinum metal oxide is used, it is preferable to coat such material on an expanded metal made of a valve metal.

When the electrodes are placed in the electrolytic cell of the present invention, it is preferable to contact the electrode with the porous non-electrode layer so as to reduce the cell voltage. The electrode, however, can be placed leaving a space such as 0.1 to 10 mm from the porous non-electrode layer. When the electrodes are placed in contact with the porous nonelectrode layer, it is preferable to contact them under a low pressure rather than high pressure.

When the porous non-electrode layer is formed on only one surface of the membrane, the electrode placed at the other side of ion exchange membrane having nonelectrode layer can be in any desired form. The electrodes having opening such as the porous plate, the gauze or the expanded metal can be placed in contact with the membrane or in leaving space to the membrane. The electrodes can be also porous layers which act as an anode or a cathode. The porous layers as the electrodes which are bonded to the ion exchange membrane are disclosed in British Patent No. 2,009,795, U.S. Pat. No. 4,210,501, No. 4,214,958 and No. 4,217,401.

The electrolytic cell used in the present invention can be monopolar or bipolar type in the abovementioned structure. The electrolytic cell used in the electrolysis of an aqueous solution of an alkali metal chloride, is made of a material being resistant to the aqueous solution of the alkali metal chloride and chlorine such as valve metal like titanium in the anode compartment and is made of a material being resistant to an alkali metal hydroxide and hydrogen such as iron, stainless steel or nickel in the cathode compartment.

The principle of the ion exchange membrane electrolytic cell of the present invention is shown in FIG. 1 wherein the reference numeral (1) designates the ion exchange membrane; (2), (3) respectively designate porous non-electrode layers in the anode side and in the catode side, which are respectively bonded on the ion exchange membrane. The anode (4) and the cathode (5) are respectively brought into contact with the porous layers and the anode (4) and the cathode (5) are respectively connected to the positive power source and the negative power source. In the electrolysis of the alkali metal chloride, an aqueous solution of an alkali metal chloride ($MCl+H_2O$) was fed into the anode compartment whereas water or a diluted aqueous solution of an alkali metal hydroxide is fed into the cathode compartment. In the anode compartment, chlorine is formed by the electrolysis and the alkali metal ion ($M^+$) is moved through the ion exchange membrane. In the cathode compartment, hydrogen is generated by the electrolysis and hydroxyl ion is also formed. The hydroxyl ion reacts with the alkali metal ion moved from the anode to produce the alkali metal hydroxide.

Figure 2:
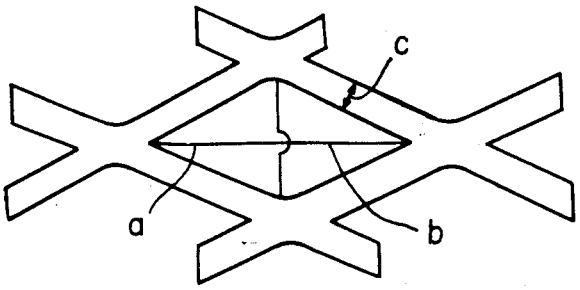
FIG. 2 is a partial plane view of an expanded metal.

FIG. 2 is a partial plane view of the expanded metal as the electrode of the electrolytic cell wherein a designates a major length; b designates a minor length and c designates a width of the wire.

Figure 3:
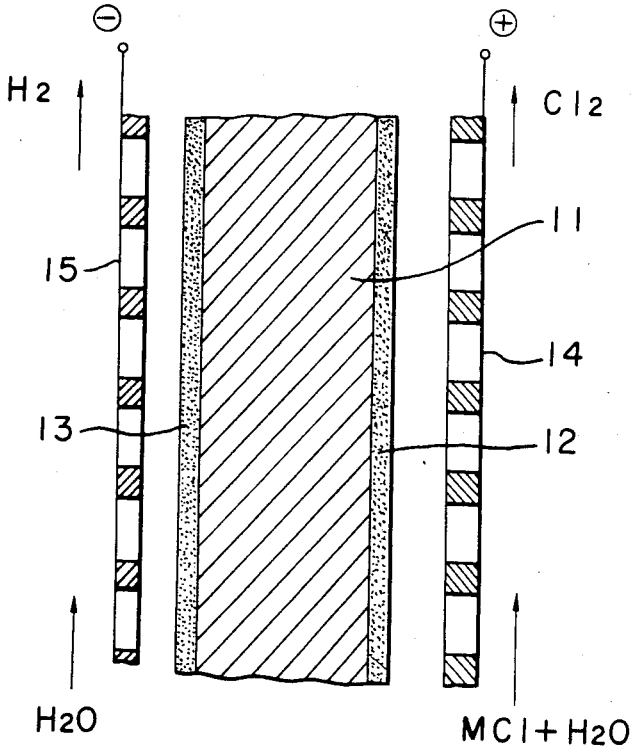
FIG. 3 is a sectional view of another embodiment of an electrolytic cell according to the present invention.

FIG. 3 is a partial view of another ion exchange membrane cell of the present invention wherein the anode (14) and the cathode (15) are placed leaving each space from the porous non-electrode layer (12) at anode side and the porous non-electrode layer (13) at cathode side respectively, both of which are bonded to the ion-exchange membrane (11). Expect these points, an aqueous solution of an alkali metal chloride was electrolysed in the same manner as in the case of FIG. 1.

In the present invention, the process condition for the electrolysis of an aqueous solution of an alkali metal chloride can be the known condition in the prior arts.

For example, an aqueous solution of an alkali metal chloride (2.5 to 5.0 Normal) is fed into the anode compartment and water or a dilute solution of an alkali metal hydroxide is fed into the cathode compartment and the electrolysis is preferably carried out at 80° to 120° C. and at a current density of 10 to 100 A/dm$^2$.

However, a current density should be low enough to maintain the porous layer bonded to the membrane to be non-electrode condition, when said porous layer is made of electric conductive material.

The alkali metal hydroxide having a concentration of 20 to 50 wt.% is produced. In this case, the presence of heavy metal ion such as calcium or magnesium ion in the aqueous solution of an alkali metal chloride causes deterioration of the ion exchange membrane, and accordingly it is preferable to minimizes the content of the heavy metal ion. In order to prevent the generation of oxygen on the anode, it is preferable to feed an acid in the aqueous solution of an alkali metal chloride.

Although the electrolytic cell for the electrolysis of an alkali metal chloride has been illustrated, the electrolytic cell of the present invention can be used for the electrolysis of water using alkali metal hydroxide having a concentration of preferably 10 to 30 weight percent, a halogen acid (HCl, HBr) an alkali metal sulfate, an alkali metal carbonate etc.

The present invention will be further illustrated by certain examples and references which are provided for purposes of illustration only and are not intended to limit the present invention.

EXAMPLE 1

In 50 ml. of water, 73 mg. of tin oxide powder having a particle diameter of less than 44∞ was dispersed. A suspension of polytetrafluoroethylene (PTFE) (Teflon 30 J manufactured by DuPont) was added to give 7.3 mg. of PTFE. One drop of nonionic surfactant was added to the mixture. The mixture was stirred by ultrasonic vibration under cooling with ice and was filtered on a porous PTFE sheet under suction to obtain a porous layer. The thin porous layer had a thickness of 30μ, a porosity of 75% and a content of tin oxide of 5 mg./cm$^2$.

On the other hand, in accordance with the same process, a thin layer having a particle diameter of less than 44μ, a content of nickel oxide of 7 mg./cm$^2$, a thickness of 35μ and a porosity of 73%. was obtained.

Both the thin layers were superposed on a cation exchange membrane made of a copolymer of $CF_2{=}CF_2$ and $CF_2{=}CFO(CF_2)_3COOCH_3$ having an ion exchange capacity of 1.45 meq/g. resin and a thickness of 210μ without contacting the porous PTFE sheet to the cation exchange membrane and they were pressed at 160° C. under a pressure of 60 kg./cm$^2$ to bond the thin porous layers to the cation exchange membrane and then, the porous PTFE sheets were peeled off to obtain the cation exchange membrane on both surfaces of which the tin oxide porous layer and the nickel oxide porous layer were respectively bonded.

The cation exchange membrane having the layers on both sides was hydrolyzed by dipping it in 25 wt.% aqueous solution of sodium hydroxide at 90° C. for 16 hours.

A platinum gauze (40 mesh) was brought into contact with the tin oxide layer surface and a nickel gauze (20 mesh) was brought into contact with the nickel oxide layer surface under pressure and an electrolytic cell was assembled by using the cation exchange membrane having the porous layers and using the platinum gauze as an anode and the nickel gauze as a cathode.

An aqueous solution of sodium chloride was fed into an anode compartment of the electrolytic cell to maintain a concentration of 4N—NaCl and water was fed into a cathode compartment and an electrolysis was performed at 90° C. to maintain a concentration of sodium hydroxide of at 35 wt.%. The results are as follows:

| Current density (A/dm$^2$) | Cell voltage (V) |
|---|---|
| 10 | 2.70 |

-continued

| Current density ($A/dm^2$) | Cell voltage (V) |
|---|---|
| 20 | 2.90 |
| 30 | 3.11 |
| 40 | 3.28 |

The current efficiency for producing sodium hydroxide at the current density of 20 $A/dm^2$ was 92%.

REFERENCE 1

In accordance with the process of Example 1 except that the cation exchange membrane without a porous layer on both sides were used and the cathode and the anode were directly brought into contact with the surface of the cation exchange membrane, an electrolytic cell was assembled and an electrolysis of an aqueous solution of sodium chloride was performed. The results are as follows:

| Current density ($A/dm^2$) | Cell voltage (V) |
|---|---|
| 10 | 2.90 |
| 20 | 3.30 |
| 30 | 3.65 |
| 40 | 3.91 |

EXAMPLE 2

In accordance with the process of Example 1 except that the thin porous tin oxide layer having a content of tin oxide of 5 mg./$cm^2$ was adhered on the surface of an anode side of the cation exchange membrane but the cathode was directly brought into contact with the surface of the cation exchange membrane without using the porous layer, an electrolysis was performed in the same condition. The results are as follows:

| Current density ($A/dm^2$) | Cell voltage (V) |
|---|---|
| 10 | 2.74 |
| 20 | 3.01 |
| 30 | 3.21 |
| 40 | 3.36 |

The current efficiency at the current density of 20 $A/dm^2$ was 91%.

EXAMPLE 3

In accordance with the process of Example 2 except that a thin porous layer of titanium oxide having a thickness of 28$\mu$, a porosity of 78% and a content of titanium oxide of 5 mg./$cm^2$ was used instead of the thin porous tin oxide layer, an electrolysis was performed. The results are as follows:

| Current density ($A/dm^2$) | Cell voltage (V) |
|---|---|
| 10 | 2.73 |
| 20 | 3.00 |
| 30 | 3.19 |
| 40 | 3.34 |

The current efficiency at the current density of 20 $A/dm^2$ was 91.5%.

EXAMPLE 4

In accordance with the process of Example 1 except that the anode was brought into contact with the surface of the ion exchange membrane without using the porous layer and a thin porous tin oxide layer having a thickness of 30$\mu$ and a porosity of 72% was used instead of the porous nickel oxide layer and an electrolysis was performed. The results are as follows:

| Current density ($A/dm^2$) | Cell voltage (V) |
|---|---|
| 10 | 2.72 |
| 20 | 2.98 |
| 30 | 3.18 |
| 40 | 3.34 |

The current efficiency at the current density of 20 $A/dm^2$ was 92.5%.

EXAMPLE 5

In accordance with the process of Example 2 except that a thin porous iron oxide layer having a content of iron oxide of 1 mg./$cm^2$ was adhered on the surface of the cation exchange membrane instead of the tin oxide layer, an electrolysis was performed in the same condition. The results are as follows:

| Current density ($A/dm^2$) | Cell voltage (V) |
|---|---|
| 10 | 2.90 |
| 20 | 3.04 |
| 30 | 3.20 |
| 40 | 3.33 |

EXAMPLE 6

In accordance with the process of Example 1 except that a cation exchange membrane, "Nafion 315" (Trade name of DuPont Company) was used and the thin porous layer tin oxide was adhered on one surface and hydrolyzed by the process of Example 1 and the concentration of sodium hydroxide produced was maintained at 25 wt.%, an electrolysis was performed. The results are as follows:

The current efficiency at the current density of 20 $A/dm^2$ was 83%.

| Current density ($A/dm^2$) | Cell voltage (V) |
|---|---|
| 20 | 2.93 |
| 40 | 3.31 |

EXAMPLES 7 TO 20

In accordance with the process of Example 1 except that the porous layers shown in Table 1 were respectively bonded to an anode side, a cathode side or both side of the surfaces of the cation exchange membrane, each electrolysis was performed by using each membrane having the porous layers. The results are shown in Table 1.

In the following table, the description of "$Fe_2O_3$—$SnO_2$ (1:1)" means a mixture of $Fe_2O_3$ and $SnO_2$ at a molar ratio of 1:1 and the symbol "—" means no bonding of any porous layer to the cation exchange membrane.

TABLE 1

| Example | metal oxide at anode side ($mg/cm^2$) | metal oxide at cathode side ($mg/cm^2$) | Cell voltage (V) 20 $A/dm^2$ | Cell voltage (V) 40 $A/dm^2$ |
|---|---|---|---|---|
| 7 | $Al_2O_3$ (2.0) | $Nb_2O_5$ (1.5) | 2.91 | 3.33 |
| 8 | $Cr_2O_3$ (2.0) | — | 3.02 | 3.38 |
| 9 | $MnO_2$ (2.5) | $Ta_2O_5$ (1.5) | 2.92 | 3.35 |
| 10 | $ZrO_2$ (1.5) | — | 3.04 | 3.40 |
| 11 | $Nb_2O_5$ (1.5) | $TiO_2$ (2.0) | 2.89 | 3.31 |
| 12 | $MoO_3$ (2.0) | $HfO_2$ (1.5) | 2.88 | 3.30 |
| 13 | $HfO_2$ (1.0) | $Fe_2O_3$ (2.0) | 2.95 | 3.41 |
| 14 | $Ta_2O_5$ (2.0) | — | 2.97 | 3.44 |
| 15 | $Fe_3O_4$ (3.0) | $Fe_3O_4$ (1.5) | 2.90 | 3.30 |
| 16 | $Fe_2O_3$—$SnO_2$ (1:1) (2.0) | — | 3.03 | 3.39 |
| 17 | $ZrO_2$—$SnO_2$ (1:1) (1.5) | — | 3.02 | 3.37 |
| 18 | $Nb_2O_5$—$ZrO_2$ (2:3) (1.5) | — | 3.01 | 3.36 |
| 19 | $Fe_2O_3$—$ZrO_2$ (1:1) (1.5) | — | 3.00 | 3.36 |
| 20 | $ZrO_2$—$TiO_2$ (1:1) (1.5) | — | 2.99 | 3.34 |

EXAMPLE 21

5 wt. parts of a hydrogel of iron hydroxide containing 4 wt. % of iron hydroxide having a particle diameter of less than 1μ; 1 wt. part of an aqueous dispersion having 20 wt.% of a modified polytetrafluoroethylene and 0.1 wt. part of methyl cellulose were thoroughly mixed and kneaded and 2 wt. parts of isopropyl alcohol was added and the mixture was further kneaded to obtain a paste.

The paste was screen-printed in a size of 20 cm×25 cm, on one surface of a cation exchange membrane made of a copolymer of $CF_2{=}CF_2$ and $CF_2{=}CFO(CF_2)_3COOCH_3$ having an ion exchange capacity of 1.45 meq./g. dry resin and a thickness of 220μ.

The cation exchange membrane was dried in air and heat-pressed at 165° C. under a pressure of 60 $kg./cm^2$. The porous layer formed on the cation exchange membrane had a thickness of 10μ, a porosity of 95% and a content of iron hydroxide of 0.2 $mg./cm^2$. The cation exchange membrane was hydrolyzed and methyl cellulose was dissolved by dipping it in 25 wt.% aqueous solution of sodium hydroxide at 90° C. for 16 hours. Then, an anode made of titanium microexpanded metal coated with Ru—Ir—Ti oxide was brought into contact with the porous. layer and a cathode made of a nickel microexpanded metal was directly brought into contact with the other surface of the cation exchange membrane to assemble an electrolytic cell.

An aqueous solution of sodium chloride was fed into an anode compartment of the electrolytic cell to maintain a concentration of 4N—NaCl and water was fed into a cathode compartment and an electrolysis was performed at 90° C. to maintain a concentration of sodium hydroxide at 35 wt.%. The results are as follows.

| Current density ($A/dm^2$) | Cell voltage (V) |
|---|---|
| 20 | 3.04 |
| 40 | 3.34 |
| 60 | 3.61 |
| 80 | 3.73 |

Said modified polytetraethylene was prepared as described belows. In a 0.2 liter stainless steel autoclave, 100 g. of water, 20 mg. of ammonium persulfate, 0.2 g. of $C_8F_{17}COONH_4$, 0.5 g. of $Na_2HPO_4.12H_2O$, 0.3 g. of $NaH_2PO_4.2H_2O$ and 5 g. of trichlorotrifluoroethane were charged. Air in the autoclave was purged with liquid nitrogen and the autoclave was heated at 57° C. and tetrafluoroethylene was fed under a pressure of 20 $kg./cm^2$ to initiate the polymerization. After 0.65 hour, the unreacted tetrafluoroethylene was purged and polytetrafluoroethylene was obtained at a latex concentration of 16 wt.%. Trichlorotrifluoroethane was evaporated from the latex and 20 g. of $CF_2{=}CFO(CF_2)_3COOCH_3$ was charged into the latex in the autoclave. Air in the autoclave was purged and the autoclave was heated to 57° C. and tetrafluoroethylene was fed under a pressure of 11 $kg./cm^2$ to perform the reaction. After 2.6 hours from the initiation of the second reaction, tetrafluoroethylene was purged to finish the reaction. Trichlorotrifluoroethane was added to the resulting latex to separate the unreacted $CF_2{=}CFO(CF_2)_3COOCH_3$ by the extraction and then, conc. sulfuric acid was added to coagulate the polymer and the polymer was thoroughly washed with water and then, treated with 8N—NaOH aqueous solution at 90° C. for 5 hours and with 1N—NCl aqueous solution at 60° C. for 5 hours and then, thoroughly washed with water and dried to obtain 21.1 g. of the polymer. The modified polytetrafluoroethylene obtained had an ion exchange capacity of —COOCH groups of 0.20 meq./g. polymer to find the fact that the modifier component was included at a ratio of about 2.1 mol %.

EXAMPLES 22 TO 26

In accordance with the process of Example 21 except that each hydrogel shown in Table 2 was bonded on an anode side, a cathode or both side instead of the hydrogel of iron hydroxide (porous layer at anode side) in the condition shown in Table 2, each electrolytic cell was assembled and each electrolysis of the aqueous solution of sodium chloride was performed. The results are shown in Table 3.

TABLE 2

| | Porous layer at anode side | | Porous layer at cathode side | |
|---|---|---|---|---|
| | Hydrogel | | Hydrogel | |
| Example | Kind | Amount (wt. part) | Kind | Amount (wt. part) |
| 22 | Titanium oxide/ Zirconium oxide (1:1) | 5 | — | — |
| 23 | Alumina | 5 | — | — |
| 24 | Lead hydroxide | 5 | — | — |
| 25 | — | — | Iron hydroxide | 5 |

TABLE 2-continued

| Example | Porous layer at anode side: Hydrogel Kind | Porous layer at anode side: Hydrogel Amount (wt. part) | Porous layer at cathode side: Hydrogel Kind | Porous layer at cathode side: Hydrogel Amount (wt. part) |
|---|---|---|---|---|
| 26 | Iron hydroxide | 5 | Iron hydroxide | 5 |

TABLE 3

| Example | Cell voltage (V) 20A/dm$^2$ | 40A/cm$^2$ | 60A/dm$^2$ |
|---|---|---|---|
| 22 | 3.05 | 3.40 | 3.66 |
| 23 | 3.07 | 3.44 | 3.70 |
| 24 | 3.07 | 3.40 | 3.64 |
| 25 | 3.02 | 3.27 | 3.55 |
| 26 | 2.95 | 3.20 | 3.48 |

EXAMPLE 27

In 50 ml. of water, 73 mg. of a molten titanium oxide powder having a particle diameter of less than 44$\mu$ was suspended and a suspension of polytetrafluoroethylene (PTFE) (Teflon 30 J manufactured by DuPont) was added to give 7.3 mg. of PTFE. One drop of nonionic surfactant was added to the mixture. The mixture was stirred under cooling with ice and was filtered on a porous PTFE membrane under suction to obtain a porous layer. The thin porous layer had a thickness of 30$\mu$, a porosity of 75% and content of titanium oxide of 5 mg./cm$^2$.

The thin layer was superposed on a cation exchange membrane made of a cpolymer of $CF_2{=}CF_2$ and $CF_2{=}CFO(CF_2)_3COOCH_3$ having an ion exchange capacity of 1.45 mg./g. resin and a thickness of 250$\mu$ to place the porous PTFE membrane and they were compressed at 160° C. under a pressure of 60 kg./cm$^2$ to bond the thin porous layer to the cation exchange membrane and then, the porous PTFE membrane was peeled off to obtain the cation exchange membrane on one surface of which the titanium oxide layer was bonded.

The cation exchange membrane with the layer was hydrolyzed by dipping it in 25 wt.% of aqueous solution of sodium hydroxide at 90° C. for 16 hours.

An anode made of titanium microexpanded metal coated with a solid solution of Ru—Ir—Ti oxide was brought into contact with the titanium oxide layer bonded to the cation exchange membrane and a cathode made of nickel microexpanded metal, was brought into contact with the other surface under pressure to assemble an electrolytic cell.

An aqueous solution of sodium chloride was fed into an anode compartment of the electrolytic cell to maintain a concentration of 4N—NaCl and water was fed into a cathode compartment and an electrolysis was performed at 90° C. to maintain a concentration of sodium hydroxide at 35 wt.%. The results are as follows.

| Current density (A/dm$^2$) | Cell voltage (V) |
|---|---|
| 20 | 3.09 |
| 40 | 3.41 |

The current efficiency for producing sodium hydroxide at the current density of 20 A/dm$^2$ was 92%.

EXAMPLE 28

In accordance with the process of Example 27 except that a stabilized Raney nickel was bonded to the surface of the cation exchange membrane for the cathode side of the membrane at a rate of 5 mg./cm$^2$, an electrolysis was performed. The results are as follows.

| Current density (A/dm$^2$) | Cell voltage (V) |
|---|---|
| 20 | 3.00 |
| 40 | 3.32 |

The current efficiency at the current density of 20 A/dm$^2$ was 92.5%.

EXAMPLE 29

A paste was prepared by mixing 100 mg. of molten tin oxide powder having a particle diameter of less than 25$\mu$, 1000 mg. of a modified polytetrafluoroethylene used in Example 21, 1.0 ml. of water and 1.0 ml. of isopropyl alcohol.

The paste was screen-printed on one surface of a cation exchange membrane made of $CF_2{=}CF_2$ and $CF_2{=}CFO(CF_2)_3COOCH_3$ having an ion exchange capacity of 1.45 meq./g. resin and a thickness of 220$\mu$ to obtain a porous layer having a content of tin oxide of 2 mg./cm$^2$. In accordance with the same process, ruthenium black was adhered at a content of 1.0 mg./cm$^2$ to form the cathode layer. These layers were bonded to the cation exchange membrane at 150° C. under a pressure of 20 kg./cm$^2$ and then, the cation exchange membrane was hydrolyzed by dipping it in 25 wt.% aqueous solution of sodium hydroxide at 90° C. for 16 hours. Then, an anode made of titanium microexpanded metal coated with ruthenium oxide and irridium oxide (3:1) and a current collector made of nickel expanded metal were brought into contact with the porous layer and the cathode layer respectively under a pressure to assemble an electrolytic cell.

5N—NaCl aqueous solution was fed into an anode compartment of the electrolytic cell to maintain a concentration of 4N—NaCl and water was fed into a cathode compartment and electrolysis was performed at 90° C. to maintain a concentration of sodium hydroxide at 35 wt.%. The results are as follows.

| Current density (A/dm$^2$) | Cell voltage (V) |
|---|---|
| 20 | 2.82 |
| 40 | 3.10 |
| 60 | 3.35 |

The current efficiency for producing sodium hydroxide at the current density of 40 A/dm$^2$ was 92%.

EXAMPLE 30

In accordance with the process of Example 29 except that a porous layer made of molten niobium pentoxide at a content of 2.0 mg/cm$^2$ was bonded to the cathode surface of the cation exchange membrane and the anode was directly brought into contact with the other surface to assemble an electrolytic cell and an electrolysis was performed. The results are as follows.

| Current density ($A/dm^2$) | Cell voltage (V) |
|---|---|
| 20 | 3.03 |
| 40 | 3.40 |
| 60 | 3.61 |

The current efficiency for producing sodium hydroxide at the current density of 40 $A/dm^2$ was 93%.

EXAMPLE 31

In accordance with the process of Example 29 except that a thin porous layer having a thickness of 28μ, a porosity of 78% and a content of titanium oxide of 5 $mg./cm^2$ was used instead of the porous molten tin oxide layer, an electrolysis was performed.
The results are as follows.

| Current density ($A/dm^2$) | Cell votlage (V) |
|---|---|
| 20 | 2.78 |
| 40 | 3.09 |

The electrolysis was performed at a current density of 20 $A/dm^2$ for 210 days in a cell voltage of 2.81 V. The cell voltage was not substantially increased. The current efficiency for the production of sodium hydroxide was constant for 94%.

EXAMPLE 32

A paste was prepared by thoroughly mixing 10 wt. parts of 2 wt.% aqueous solution of methyl cellulose (MC) with 2.5 wt. parts of 20 wt.% aqueous dispersion of polytetrafluoroethylene having a particle diameter of less than 1μ (PTFE) and 5 wt. parts of titanium powder having a particle diameter of less than 25μ and further admixing 2 wt. parts of isopropyl alcohol and 1 wt. part of cyclohexanol.

The paste was screen-printed in a size of 20 cm×25 cm on one surface of a cation exchange membrane made of a copolymer of $CF_2{=}CF_2$ and $CF_2{=}CFO(CF_2)_3COOCH_3$ having an ion exchange capacity of 1.45 meq./g. dry resin and a thickness of 220μ by using a stainless steel screen having a thickness of 60μ (200 mesh) and a printing plate having a screen mask having a thickness of 8μ and a polyurethane squeezer.

The printed layer formed on one surface of the cation exchange membrane was dried in air to solidify the paste. On the other hand, a stabilized Raney nickel (Raney nickel was developed and partially oxidized) having a particle diameter of less than 25μ was screen-printed on the other surface of the cation exchange membrane. Thus, the printed layer was adhered on the cation exchange membrane at 140° C. under a pressure of 30 $kg./cm^2$. The cation exchange membrane was hydrolyzed and methyl cellulose was dissolved by dipping it in 25% aqueous solution of sodium hydroxide at 90° C. for 16 hours.

The titanium layer formed on the cation exchange membrane had a thickness of 20μ and a porosity of 70% and a content of titanium of 1.5 $mg./cm^2$ and the Raney nickel layer had a thickness of 24μ, a porosity of 75% and a content of Raney nickel of 2 $mg./cm^2$.

An anode made of titanium expanded metal (2.5 mm×5 mm) coated with a solid solution of ruthenium oxide and iridium oxide and titanium oxide which had low chlorine overvoltage was brought into contact with the surface of the cation exchange membrane for the titanium layer. A cathode made of SUS 304 expanded metal (2.5 mm×5 mm) etched in 52% aqueous solution of sodium hydroxide at 150° C. for 52 hours to give low hydrogen overvoltage was brought into contact with the stabilized Raney nickel layer under a pressure.

An aqueous solution of sodium chloride was fed into an anode compartment of the electrolytic cell to maintain a concentration of 4N—NaCl and an electrolysis was performed at 90° C. to maintain a concentration of sodium hydroxide of 35 wt.%. The results are as follows.

| Current density ($A/dm^2$) | Cell voltage (V) |
|---|---|
| 20 | 2.81 |
| 40 | 3.01 |
| 60 | 3.25 |

A current efficiency at the current density of 40 $A/dm^2$ was 93%. The electrolysis was continued at the current density of 40 $A/dm^2$ for 1 month. The cell voltage was substantially constant.

EXAMPLE 33

In accordance with the process of Example 32 except that tantalum powder was used instead of titanium and stainless steel was used instead of the stabilized Raney nickel, the tantalum layer and the stainless steel layer were bonded to the surfaces of the cation exchange membrane and a electrolysis was performed. The result is as follows.

| Current density ($A/dm^2$) | Cell voltage (V) |
|---|---|
| 20 | 2.85 |
| 40 | 3.03 |
| 60 | 3.29 |

EXAMPLE 34

In accordance with the process of Example 32 except that a cation exchange membrane made of a copolymer of $CF_2{=}CF_2$ and $CF_2{=}CFOCF_2CF(CF_3)O(CF_2)_2SO_2F$ having an ion exchange capacity of 0.67 meq/g. dry resin whose surface in the cathode side was treated with amine was used and the titanium layer and the stabilized Raney nickel layer were bonded to the surfaces of the membrane and the membrane was hydrolyzed and an electrolysis was performed.

| Current density ($A/dm^2$) | Cell voltage (V) |
|---|---|
| 20 | 2.98 |
| 40 | 3.19 |
| 60 | 3.40 |

The current efficiency for producing sodium hydroxide at the current density of 40 $A/dm^2$ was 85%.

EXAMPLE 36

In accordance with the process of Example 32 except that the anode was directly brought into contact with the surface of the cation exchange membrane and a stabilized Raney nickel layer was adhered on the other surface of the membrane for the cathode and an electrolysis was performed. The results are as follows.

| Current density ($A/dm^2$) | Cell voltage (V) |
|---|---|
| 20 | 2.89 |
| 40 | 3.13 |
| 60 | 3.38 |

The current efficiency for producing sodium hydroxide at the current density of 40 $A/dm^2$ was 92.5%.

EXAMPLE 37

A paste was prepared by mixing 10 wt. parts of 2% methyl cellulose aqueous solution with 2.5 wt. parts of 7% aqueous dispersion of a modified polytetrafluoroethylene (PTFE) (the same as used in Example 21) and 5 wt. parts of titanium oxide powder having a particle diameter of 25μ and adding 2 wt. parts of isopropyl alcohol and 1 wt. part of cyclohexanol and kneading the mixture.

The paste was printed by screen printing method in a size of 20 cm×25 cm on one surface of a cation exchange membrane made of a copolymer of $CF_2{=}CF_2$ and $CF_2{=}CFO(CF_2)_3COOCH_3$ having an ion exchange capacity of 1.43 meq/g. dry resin and a thickness of 210μ by using a printing plate having a stainless steel screen (200 mesh) having a thickness of 60μ and a screen mask having a thickness of 8μ and a polyurethane squeezer.

The printed layer formed on one surface of the cation exchange membrane was dried in air to solidify the paste. In accordance with the same process, titanium oxide having a particle diameter of less than 25μ was screen-printed on the other surface of the membrane. The printed layers were bonded to the cation exchange membrane at 140° C. under the pressure of 30 $kg/cm^2$ and then, the cation exchange membrane was hydrolyzed and methyl cellulose was dissolved by dipping it in 25% aqueous solution of sodium hydroxide at 90° C. for 16 hours.

Each titanium oxide layer formed on the cation exchange membrane had a thickness of 20μ, a porosity of 70% and a content of titanium oxide of 1.5 $mg/cm^2$.

EXAMPLES 38 TO 55

In accordance with the process of Example 37, each cation exchange membrane having a porous layer made of the material shown in Table 4 on one or both surfaces was obtained.

In Examples 40, 46 and 53, 2.5 wt. part of 20% aqueous dispersion of PTFE coated with a copolymer of $CF_2{=}CF_2$ and $CF_2{=}CFO(CF_2)COOCH_3$ having a particle diameter of less than 0.5μ was used instead of the aqueous dispersion of PTFE. In Examples 42, 48 and 52, PTFE was not used.

TABLE 4

| Example | Porous layer (anode side) | | Porous layer (cathode side) | |
|---|---|---|---|---|
| 38 | $TiO_2$ | (1.5 $mg/cm^2$) | $Fe_2O_3$ | (1.0 $mg/cm^2$) |
| 39 | $Fe_2O_3$ | (1.0 $mg/cm^2$) | $TiO_2$ | (1.0 $mg/cm^2$) |
| 40 | $Ta_2O_5$ | (1.2 $mg/cm^2$) | $Nb_2O_5$ | (1.2 $mg/cm^2$) |
| 41 | $Nb_2O_5$ | (1.2 $mg/cm^2$) | $Ta_2O_5$ | (1.2 $mg/cm^2$) |
| 42 | $Fe(OH)_3$ | (0.5 $mg/cm^2$) | Ni | (1.0 $mg/cm^2$) |
| 43 | Ti | (1.0 $mg/cm^2$) | C | (1.0 $mg/cm^2$) |
| 44 | Ta | (1.0 $mg/cm^2$) | Ag | (1.0 $mg/cm^2$) |
| 45 | $TiO_2$ | (1.5 $mg/cm^2$) | | — |

TABLE 4-continued

| Example | Porous layer (anode side) | | Porous layer (cathode side) | |
|---|---|---|---|---|
| 46 | $Fe_2O_3$ | (1.0 $mg/cm^2$) | | — |
| 47 | $Ta_2O_5$ | (1.2 $mg/cm^2$) | | — |
| 48 | $Nb_2O_5$ | (1.2 $mg/cm^2$) | | — |
| 49 | $Fe(OH)_3$ | (0.5 $mg/cm^2$) | | — |
| 50 | Ti | (1.0 $mg/cm^2$) | | — |
| 51 | | — | $TiO_2$ | (1.0 $mg/cm^2$) |
| 52 | | — | $Fe_2O_3$ | (1.0 $mg/cm^2$) |
| 53 | | — | $Nb_2O_5$ | (1.2 $mg/cm^2$) |
| 54 | | — | Ni | (1.0 $mg/cm^2$) |
| 55 | | — | C | (1.0 $mg/cm^2$) |

EXAMPLES 56 TO 58

In accordance with the process of Example 37, a cation exchange membrane, "Nafion 315" (Trade name of Dupont Company), was used to bond each porous layer shown in Table 5 to prepare each cation exchange membrane having the porous layers.

TABLE 5

| Example | Porous layer (anode side) | | Porous layer (cathode side) | |
|---|---|---|---|---|
| 56 | $TiO_2$ | (1.5 $mg/cm^2$) | $Fe_2O_3$ | (1.0 $mg/cm^2$) |
| 57 | $Ta_2O_5$ | (1.2 $mg/cm^2$) | | — |
| 58 | | — | Ni | (1.0 $mg/cm^2$) |

EXAMPLE 59

An anode made of titanium microexpanded metal coated with a solid solution of ruthenium oxide, iridium oxide and titanium oxide which had low chlorine overvoltage and a cathode made of SUS304 microexpanded metal (2.5 mm×5.0 mm) treated by etching in 52% NaOH solution at 150° C. for 52 hours which had low hydrogen overvoltage, were brought into contact with each cation exchange membrane having the porous layers under a pressure of 0.01 $kg/cm^2$.

An aqueous solution of sodium chloride was fed into an anode compartment of the electrolytic cell to maintain a concentration of 4N—NaCl and water was fed into a cathode compartment and each electrolysis was performed at 90° C. to maintain a concentration of sodium hydroxide of 35 wt.% at a current density of 40 $A/dm^2$. The results are shown in Table 6. The cation exchange membranes having the porous layer used in the electrolysis are shown by the numbers of Examples.

TABLE 6

| Test No. | Membrane having porous layer (Example No.) | Cell voltage (V) | Current efficiency (%) |
|---|---|---|---|
| 1 | 37 | 3.01 | 93.0 |
| 2 | 39 | 2.98 | 93.5 |
| 3 | 41 | 2.97 | 94.0 |
| 4 | 43 | 3.05 | 92.1 |
| 5 | 45 | 3.10 | 94.5 |
| 6 | 49 | 3.09 | 95.0 |
| 7 | 51 | 3.12 | 92.3 |
| 8 | 55 | 3.11 | 91.6 |
| 9 | 56 | 3.21 | 82.4 |

EXAMPLE 60

In accordance with the process of Example 59 except that the anode and the cathode were placed departing from the cation exchange membrane for 1.0 mm without contacting them, each electrolysis was performed. The results are shown in Table 7.

TABLE 7

| Test No. | Membrane having porous layer (Example No.) | Cell voltage (V) | Current efficiency (%) |
|---|---|---|---|
| 1 | 37 | 3.11 | 93.3 |
| 2 | 39 | 3.08 | 93.7 |
| 3 | 41 | 3.06 | 94.5 |
| 4 | 43 | 3.17 | 93.0 |
| 5 | 45 | 3.20 | 95.0 |
| 6 | 49 | 3.29 | 95.2 |
| 7 | 51 | 3.33 | 93.3 |
| 8 | 55 | 3.35 | 92.1 |
| 9 | 56 | 3.42 | 83.3 |

EXAMPLE 61

In accordance with the process of Example 59 using the anode and the cathode which were respectively brought into contact with the cation exchange membrane having the porous layer under a pressure of 0.01 kg/cm$^2$, each electrolysis of potassium chloride was performed.

3.5N-aqueous solution of potassium chloride was fed into an anode compartment to maintain a concentration of 2.5N—KCl and water was fed into a cathode compartment and each electrolysis was performed at 90° C. to maintain a concentration of potassium hydroxide of 35 wt.% at a current density of 40 A/dm$^2$. The results are shown in Table 8.

TABLE 8

| Test No. | Membrane having porous layer (Example No.) | Cell voltage (V) | Current efficiency (%) |
|---|---|---|---|
| 1 | 38 | 3.03 | 97.0 |
| 2 | 40 | 3.01 | 96.5 |
| 3 | 48 | 3.12 | 97.4 |
| 4 | 54 | 3.10 | 96.3 |

EXAMPLE 62

An anode made of nickel microexpanded metal (2.5 mm×5 mm) and a cathode made of SUS303 microexpanded metal (2.5 mm×5.0 mm) treated by etching in 52% NaOH aqueous solution at 150° C. for 52 hours which had low hydrogen overvoltage were brought into contact with each cation exchange membrane having the porous layers under a pressure of 0.01 kg/cm$^2$.

An aqueous solution of potassium hydroxide having a concentration of 30% was fed into an anode compartment and water was fed into a cathode compartment and water electrolysis was performed at 90° C. to maintain a concentration of potassium hydroxide at 20 wt.% at a current density of 50 A/dm$^2$. The results are shown in Table 9.

TABLE 9

| Test No. | Membrane having porous layer (Example No.) | Cell voltage (V) |
|---|---|---|
| 1 | 37 | 1.81 |
| 2 | 42 | 1.85 |

We claim:

1. An ion exchange membrane cell which comprises an anode, a cathode, an anode compartment and a cathode compartment formed by partitioning the cell with an ion exchange membrane comprising a gas and liquid permeable porous particulate non-electrode layer bonded to at least one surface of said ion exchange membrane wherein at least one of said anode and said cathode is in contact with said porous particulate non-electrode layer.

2. The electrolytic cell of claim 1 wherein said porous non-electrode layer has a porosity of 10 to 99% and a thickness of 0.01 to 200μ.

3. The electrolytic cell of claim 1 or 2 wherein said porous non-electrode layer comprises non-conductive material which is electrochemically inactive.

4. The electrolytic cell of claim 1 or 2 wherein said porous non-electrode layer is made of a conductive material which has a higher over-voltage than that of the electrode.

5. The electrolytic cell of claim 1, wherein said porous non-electrode layer comprises non-conductive or conductive particles in an amount of 0.01 to 30 mg/cm$^2$.

6. The electrolytic cell of claim 5 wherein said porous non-electrode layer is formed by bonding said non-conductive or conductive particles with a fluorinated polymer.

7. The electrolytic cell of claim 6 wherein said fluorinated polymer is polytetrafluoroethylene.

8. The electrolytic cell of claim 7 wherein said fluorinated polymer is modified tetrafluoroethylene copolymerized with a fluorinated monomer having a acid group.

9. The electrolytic cell of claim 5 wherein said porous non-electrode layer is formed by mixing said electric non-conductive or conductive particles with a water soluble viscosity controlling agent.

10. The electrolytic cell of claim 9 wherein said viscosity controling agent is selected from the group consisting of cellulose derivatives and glycols.

11. The electrolytic cell of claim 3 wherein said electric non-conductive material is selected from the group consisting of an oxide, a hydroxide, a nitride or a carbide of metals in IV-A Group, IV-B Group, V-B Group, VI-B Group, iron Group, aluminum, manganese, antimony and alloys thereof.

12. The electrolytic cell of claim 11 wherein said material is a hydrogel of a metal oxide or hydroxide.

13. The electrolytic cell of claim 11 wherein said material is a molten metal oxide.

14. The electrolytic cell of claim 4 wherein said electric conductive material is selected from the group consisting of metals in IV-A Group, IV-B Group, V-B Group, VI-B Group, iron Group, aluminum, manganese, antimony and alloy thereof.

15. The electrolytic cell of claim 14 wherein said material is titanium, tantalum, carbon, nickel or silver.

16. The electrolytic cell of claim 5 or 6 wherein said porous non-electrode layer is formed by screen-printing a paste of a non-conductive or conductive material on a surface of said ion exchange membrane.

17. The electrolytic cell of claim 1 or 2, wherein said anode or said cathode is a porous plate, a mesh or an expanded metal.

18. The electrolytic cell of claim 17 wherein said anode comprises a valve metal coated with a platinum group metal or electrically conductive platinum group metal oxide.

19. The electrolytic cell of claim 17 wherein said cathode comprises iron group metal, Raney nickel, stabilized Raney nickel, stainless steel, stainless steel or nickel rhodanide.

20. The electrolytic cell of claim 1 or 2 wherein said ion exchange membrane is a cation exchange membrane comprising fluorinated polymer containing sulfonic acid groups, carboxylic acid groups or phosphoric acid groups.

21. A method of electrolyzing an alkali metal chloride solution in a cell comprising an anode in an anode compartment and a cathode in a cathode compartment separated by an ion exchange membrane having a porous, non-catalytic layer of particles on at least one surface of said ion exchange membrane wherein at least one of said anode and cathode contacts said porous, non-catalytic layer of particles, the layer of particles having a higher overvoltage than the contacting electrode, passing an electrical current from anode to cathode evolving chlorine at the anode and hydroxyl ions at the cathode.

22. A method of electrolyzing an alkali metal chloride solution in a cell comprising an anode in an anode compartment and a cathode in a cathode compartment separated by an ion exchange membrane in contact with a porous non-electrode layer comprising polytetrafluoroethylene and a non-catalytic, electrically non-conductive, inorganic particulate material dispersed through the porous layer wherein said cathode contacts said porous layer, passing an electrical current from anode to cathode, evolving chlorine at the anode and hydroxyl ions at the cathode.

23. A method of electrolyzing an alkali metal chloride solution in a cell comprising an anode in and anode compartment and a cathode in a cathode compartment separated by an ion exchange membrane in contact with a porous non-electrode matrix comprising a polytetrafluoroethylene and a non-catalytic, electrically conductive inorganic particulate material dispersed through the porous matrix wherein said cathode contacts said porous layer and said inorganic material has a higher overvoltage than the contacting electrode, passing an electrical current from anode to cathode, evolving chlorine at the anode and hydroxyl ions at the cathode.

24. A method of electrolyzing an alkali metal chloride solution in a cell comprising an anode in an anode compartment and a cathode in a cathode compartment separated by an ion exchange membrane having a porous particulate electroconductive, non-catalytic layer on the cathode surface of said ion exchange membrane wherein said cathode contacts said porous, electroconductive, non-catalytic layer and said porous electroconductive, non-catalytic layer has a higher hydrogen overvoltage than the contacting cathode, evolving chlorine at the anode and hydroxyl ions at the cathode.

25. A method of electrolyzing sodium chloride solution in a cell comprising:

a platinum guaze anode in an anode compartment a nickel guaze cathode in a cathode compartment separated by a 250$\mu$ thick ion exchange membrane comprising a hydrolyzed copolymer of $CF_2{=}CF_2$ and $CF_2{=}CFO(CF_2)_3{-}COOCH_3$ having an ion exchange capacity of 1.45 meq/g resin wherein at least one of the cathode or anode surfaces of said ion exchange membrane contains a porous non-electrode layer comprising particulate material, when said porous layer is adhered to the cathode surface of said ion exchange membrane said particulate material is selected from the group consisting of nickel oxide, and tin oxide and when said porous layer is adhered to the anode surface of said ion exchange membrane the particulate material is selected from the group consisting of tin oxide and titanium oxide wherein when said porous layer is on the cathode surface of the ion exchange membrane, the cathode is in contact with said porous layer and when said porous layer is on the anode side of the ion exchange membrane the anode is in contact with said porous layer, passing electrical current from anode to cathode, evolving chlorine at the anode and hydroxyl ions at the cathode.

26. An electrolysis cell comprising an anode in an anode compartment and a cathode in a cathode compartment separated by an ion exchange membrane having a porous, non-catalytic layer of particles on at least one surface of said ion exchange membrane wherein at least one of said anode and cathode contacts said porous, non-catalytic layer of particles, the layer of particles having a higher overvoltage than the contacting electrode.

27. An electrolysis cell comprising an anode in an anode compartment and a cathode in a cathode compartment separated by an ion exchange membrane in contact with a porous non-electrode layer comprising a polytetrafluoroethylene and a non-catalytic, electrically non-conductive, inorganic particulate material dispersed through the porous layer wherein said cathode contacts said porous layer.

28. An electrolysis cell comprising an anode in an anode compartment and a cathode in a cathode compartment separated by an ion exchange membrane in contact with a porous matrix comprising polytetrafluoroethylene and a non-catalytic, electrically conductive, inorganic particulate material dispersed through the porous material wherein said cathode contacts said porous matrix and said inorganic material has a higher overvoltage than the cathode.

29. An electrolysis cell comprising an anode in an anode compartment and a cathode in a cathode compartment separated by an ion exchange membrane having a porous, particulate, non-electrode electroconductive, non-catalytic layer on the cathode surface of said ion exchange membrane wherein said cathode contacts said porous electroconductive non-catalytic layer and said porous, electroconductive, non-catalytic layer has a higher hydrogen overvoltage than the contacting cathode.

30. An electrolysis cell comprising:

a platinum guaze anode in an anode compartment a nickel guaze cathode in a cathode compartment separated by a 250$\mu$ thick ion exchange membrane comprising a hydrolyzed copolymer of $CF_2{=}CF_2$ and $CF_2{=}CFO(CF_2)_3{-}COOCH_3$ having an ion exchange capacity of 1.45 meq/g resin wherein at least one of the cathode or anode surfaces of said ion exchange membrane contains a porous non-electrode layer comprising particulate material, when said porous layer is adhered to the cathode surface of said ion exchange membrane said particulate material is selected from the group consisting of nickel oxide, and tin oxide and when said porous layer is adhered to the anode surface of said ion exchange membrane the particulate material is selected from the group consisting of tin oxide and titanium oxide wherein when said porous layer is on the cathode surface of the ion exchange membrane, the cathode is in contact with said porous layer and when said porous layer is on the anode side of the ion exchange membrane the anode is in contact with said porous layer.

* * * * *